United States Patent [19]

Urbanic

[11] Patent Number: 4,502,890

[45] Date of Patent: Mar. 5, 1985

[54] PURIFICATION OF SUGAR LIQUORS WITH ACTIVATED CARBON

[75] Inventor: John E. Urbanic, Pittsburgh, Pa.

[73] Assignee: Calgon Carbon Corporation, Pittsburgh, Pa.

[21] Appl. No.: 439,980

[22] Filed: Nov. 8, 1982

Related U.S. Application Data

[63] Continuation-in-part of Ser. No. 239,836, Mar. 2, 1981, abandoned.

[51] Int. Cl.[3] ..... C13D 3/14

[52] U.S. Cl. ..... 127/46.2; 127/46.1; 127/55

[58] Field of Search ..... 127/55, 46.1, 40, 69, 127/46.2; 210/694, 917; 252/444; 502/416

[56] References Cited

U.S. PATENT DOCUMENTS

| | | | |
|---|---|---|---|
| 1,979,781 | 11/1934 | Scherpenberg | 127/46.1 X |
| 2,549,840 | 4/1951 | Montgomery et al. | 127/55 |
| 3,551,203 | 12/1970 | Corson et al. | 127/55 X |
| 4,149,995 | 4/1979 | Murty | 252/444 |
| 4,182,634 | 1/1980 | Yamada et al. | 127/55 |
| 4,230,602 | 10/1980 | Bowen et al. | 48/209 |
| 4,396,585 | 8/1983 | Rosene | 502/60 X |

OTHER PUBLICATIONS

Cane Sugar Handbook (10th Ed.), Meade-Chen; John Wiley and Sons, N.Y., pp. 470-472.

Calgon Product Bulletin, No. 23-107D, "Type CPG Granular Carbon," Calgon Corp.

Calgon Product Bulletin, No. 23-106E, "Type BPL Granular Carbon," Calgon Corp.

Calgon Product Bulletin, No. 23-108A, "Type PCB Granular Carbon," Calgon Corp.

*Primary Examiner*—Kenneth M. Schor

*Attorney, Agent, or Firm*—R. Brent Olson; Ernest V. Linek; William C. Mitchell

[57] ABSTRACT

A process for the purification of sugar liquors with activated carbon is described. The use of activated carbon with an iodine number at least 1200 and an average particle size in the range of 0.4 mm to 4.0 mm allows for increased flow rates resulting in high yield of purified sugar liquors.

2 Claims, No Drawings

PURIFICATION OF SUGAR LIQUORS WITH ACTIVATED CARBON

CROSS REFERENCE TO RELATED APPLICATION

This application is a continuation-in-part of copending application Ser. No. 239,836, filed Mar. 2, 1981 and now abandoned.

BACKGROUND OF THE INVENTION

This invention is directed to a method of purification and decolorization of sugar liquors.

This invention especially relates to an improved method for the purification and decolorization of sugar liquors including starch hydrolyzates such as corn syrup.

More particularly, this invention provides for a purification of sugar liquors through the use of a special granular activated carbon resulting in final products of high purity.

The term, "sugar liquors," as used herein, includes solutions of starch hydrolyzate which contain a mixture of mono-, di-, and higher polysaccharides and it particularly includes sugar solutions derived from cane, beet and corn sources. The term, "oligosaccharide," as used herein, is a carbohydrate containing from 2 to 8 simple sugars linked together. Combinations of more that 8 simple sugars are polysaccharides. A starch hydrolyzate is defined as an aqueous mixture of sugar components derived from acid, enzyme or other treatment of starchy materials.

The purification of sugar liquors such as corn syrup, cane sugar and relatively impure solutions of dextrose is one of the oldest established industrial chemical procedures.

Aqueous solutions of certain sugars such as glucose occur industrially in the hydrolysis of amylaceous or cellulosic materials. For example, large quantities of glucose solutions are prepared by the hydrolysis of starch in the manufacture of corn syrup, corn sugar and dextrose. These solutions contain minor but significant amounts of other sugars not removed by conventional refining procedures.

One use for activated carbon is the decolorization of sugar liquors. Typically the powdered activated carbon is slurried with the impure liquor one or more times followed by filtration of the decolorized liquor. Decolorization is also accomplished by passing the liquors through a column of granular activated carbon. These procedures remove color-causing impurities but only incidental amounts of oligosaccharides present in the liquor.

Another use of activated carbon involves the adsorption of high molecular weight sugars in addition to color causing impurities. Activated carbon has been employed in a column chromatography system for removing such impurities from a glucose solution as described in U.S. Pat. No. 2,549,840. Cakes of powdered activated carbon have been used in a series of filters to accomplish the removal of impurities from sugar liquors as described in U.S. Pat. No. 3,551,203.

These purification techniques generally require either a large amount of activated carbon or suffer from low flow rates, resulting in a poor yield or purified sugar product.

SUMMARY OF THE INVENTION

The object of this invention is directed to an improved method for the purification of sugar liquors. Thus, there is shown the use of a special granular activated carbon which due to its high iodine number and large average particle size allows for a reduction in the amount of activated carbon necessary and for an increased flow rate through a carbon filter process such as described above. This invention allows the use of high flow rates with the benefit of increased yield of purified sugar product over the prior art. This high yield reduces both capital and operating cost for processes to remove oligosaccharides and polysaccharides from impure sugar liquors.

Thus there is provided an improvement in the method of purifying and decolorizing sugar liquors which includes contacting said sugar liquors with a sufficient amount of activated carbon to adsorb oligosaccharides containing 3 or more saccharide groups. Said contact is maintained for a period of time sufficient to accomplish substantially complete adsorption of said oligosaccharides. The improvement comprises the use of granular activated carbon with an iodine number of at least 1,200, preferably at least 1,400 and an average particle size in the range of 0.4 mm to 4.0 mm.

DETAILED DESCRIPTION

The activated carbon employed in this improved method must have an iodine number of at least 1,200 and an average particle size (diameter) in the range of 0.4 mm to 4.0 mm. Typical prior art activated carbons (powered or granular) used in sugar purification had iodine numbers from below 500 to about 1,000. Generally, an increase in iodine number reflects an increase in adsorptive capacity. The iodine number is useful in quantifying the adsorbtive capacity of the activated carbon. The iodine number is defined as the milligrams of iodine adsorbed from an aqueous iodine-potassium iodine solution by one gram of activated carbon when the iodine concentration of the residual filtrate is 0.02 normal.

The method of application of the improved purification process of this invention can best be understood by reference to the purification of a corn syrup solution. A corn syrup solution by definition is a dextrose hydrolyzate of less than 99% dextrose. Dextrose, or D(+)-glucose has a variety of uses especially in its pure form. For example, dextrose with no impurities would give an excellent product to breweries for beer fermentation. The higher molecular weight sugars present in dextrose hydrolyzate, if not removed, would contribute to an increased caloric content of the final beer. High purity dextrose would also be an advantage in the production of sorbitol where the oligosaccharides of 3 or more sugars interfere with hydrogenation.

Although the present invention is described in connection with a preferred embodiment it is to be understood that modifications and variations may be used without departing from the spirit of the invention.

Enzymatic conversion of starch yields a dextrose hydrolyzate solution comprised of approximately 95–98% dextrose, 1–3% maltose (DP-2) and approximately 1–2% maltotriose and higher saccharide sugars (DP-3 and DP-3+). The term "DP-n" refers to the degree of polymerization where n is the number of sugar units in polymer. Thus, DP-n (where n=3 and above) represents the oligosaccharides to be adsorbed by the granular activated carbon as shown in this invention.

The dextrose hydrolyzate syrup to be purified can be treated as an aqueous solution of from 18.5 to 30.0% dry substance. The range is dependent on preventing decomposition of the liquor and on keeping the viscosity at a reasonable, i.e., workable level.

In general, the purification of a hydrolyzate solution according to the present invention is accomplished by passing the solution through a series of columns, containing granular activated carbon with an iodine number of at least 1,200 and with an average particle size in the range of 0.4 mm to 4.0 mm at a flow rate in a range of 1 to 3 gpm/ft$^2$ (gallons per minute per square feet) column cross sectional area generating a contact time in each column in a range of about 10 to 30 minutes. Higher flow rates are possible, but to maintain high purity levels, a contact time of about 30 minutes is preferred.

The following examples will more completely illustrate the practice of this invention. It will be readily understood that these examples should not be construed as limiting the scope of this invention in any way. They merely illustrate one of the many variations possible through the practice of this method.

EXAMPLE 1

A crude starch hydrolyzate, comprised of 97% dextrose, 2.4% DP-2, 0.2% DP-3 and 0.4% DP-4 was purified on a series of eight, four foot by one inch (i.d.) columns each loaded with 255 grams (600 cc) of granular activated carbon (type CPG, available from Calgon Carbon Corporation, Pittsburgh, Pa.) with an iodine number in the range of 1,000 to 1,050 and an average particle size in the range of 0.9 mm to 1.5 mm, at a flow rate of 20.8 ml/min. generating a contact time in each column of about 30 minutes. The yield of purified dextrose (98.5% dextrose - 1.5% DP-2) was between 20–25 grams per gram of activated carbon.

EXAMPLE 2

The crude starch hydrolyzate of Example 1 was purified through the series of columns of Example 1 loaded with 600 cc of granular activated carbon (type BPL-F3 available from Calgon Carbon Corporation, Pittsburgh, Pa.) with an iodine number in the range of 1,200 to 1,400 and an average particle size in the range of 0.9 mm to 1.5 mm at a flow rate of 20.8 ml/min. generating a contact time in each column of about 30 minutes. The yield of purified dextrose (98.5% dextrose -1.5% DP-2) was between 45–50 grams per gram of activated carbon.

These two examples demonstrate the unexpected advantage of using a carbon having the claimed properties (Example 2) over a typical prior art carbon (Example 1). At identical flow rates and contact times, the yield of purified dextrose was improved 100% by the process of the present invention. Thus, by practice of this invention, yields of purified sugar liquors may be significantly increased.

What is claimed is:

1. In the method of purifying and decolorizing starch hydrolysate which comprises contacting said starch hydrolysate with a sufficient amount of activated carbon to decolorize and to adsorb oligosaccharides containing 3 or more saccharide groups, maintaining said contact for a period of time sufficient to accomplish substantially complete adsorption of color causing impurities and said oligosaccharides;

the improvement comprising:

passing said starch hydrolysate into contact with said granular activated carbon at a flow rate of 1.0 to 3.0 gallons per minute/ft$^2$, wherein said granular activated carbon has an iodine number of at least 1,200 and an average particle diameter in the range of 0.4 mm to 4.0 mm.

2. The improvement of claim 1 wherein the granular activated carbon has an iodine number of at least 1,400.

* * * * *